US010024523B2

(12) United States Patent
Delano

(10) Patent No.: US 10,024,523 B2
(45) Date of Patent: Jul. 17, 2018

(54) ADJUSTABLE LIGHT MODULE FOR LIGHT FIXTURE

(71) Applicant: Howard D. Delano, Kingston, NY (US)

(72) Inventor: Howard D. Delano, Kingston, NY (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 15/705,933

(22) Filed: Sep. 15, 2017

(65) Prior Publication Data

US 2018/0073705 A1 Mar. 15, 2018

Related U.S. Application Data

(60) Provisional application No. 62/395,102, filed on Sep. 15, 2016.

(51) Int. Cl.

| | |
|---|---|
| ***F21V 17/02*** | (2006.01) |
| ***F21V 29/76*** | (2015.01) |
| ***F21V 7/00*** | (2006.01) |
| ***F21V 14/02*** | (2006.01) |
| *F21Y 115/10* | (2016.01) |

(52) U.S. Cl.

CPC ..... *F21V 17/02* (2013.01); *F21V 7/00* (2013.01); *F21V 14/02* (2013.01); *F21V 29/76* (2015.01); *F21Y 2115/10* (2016.08)

(58) Field of Classification Search

CPC . F21V 17/02; F21V 29/76; F21V 7/00; F21V 14/02; F21V 21/041; F21S 8/026; F21S 8/028; F21Y 2115/10

USPC ..... 362/366, 365, 147, 148, 150

See application file for complete search history.

(56) References Cited

U.S. PATENT DOCUMENTS

| | | | | |
|---|---|---|---|---|
| 4,729,080 A * | 3/1988 | Fremont | F21V 21/04 | 362/148 |
| 5,548,499 A * | 8/1996 | Zadeh | F21S 8/02 | 362/147 |
| 5,564,815 A * | 10/1996 | Littman | F21S 8/028 | 362/147 |
| 5,803,585 A * | 9/1998 | Littman | F21S 8/028 | 362/147 |
| 8,403,533 B1 * | 3/2013 | Paulsel | F21S 8/026 | 362/249.02 |
| 2011/0051410 A1 * | 3/2011 | Liang | F21S 8/02 | 362/235 |

(Continued)

*Primary Examiner* — Laura Tso

(74) *Attorney, Agent, or Firm* — St. Onge Steward Johnston & Reens LLC

(57) ABSTRACT

A lighting module for a recessed light fixture has a housing and a light module body movably coupled to the housing by a linkage. In an intermediate tilted position, an optical axis of the light module body is aligned at a first angle relative to a Y axis, and in a fully-tilted limit position, the optical axis is aligned at a second angle relative to the Y axis. Movement of the light module body relative to the housing includes rotation about a Z axis and translation parallel to X and Y axes. During movement of the light module body relative to the housing a first lateral section of a peripheral edge defining an opening of the light module body remains substantially parallel to the Z axis and maintains a substantially constant perpendicular distance from the X axis.

19 Claims, 12 Drawing Sheets

(56) References Cited

U.S. PATENT DOCUMENTS

2012/0287625 A1* 11/2012 Macwan ..... F21V 29/004
362/235
2015/0241039 A1* 8/2015 Fryzek ..... F21V 21/14
362/419
2016/0265756 A1* 9/2016 Silver ..... F21S 8/02

* cited by examiner

ADJUSTABLE LIGHT MODULE FOR LIGHT FIXTURE

FIELD OF THE INVENTION

The present invention is directed to the field of light fixtures, and in particular to light modules suitable for recessed light fixtures.

BACKGROUND OF THE INVENTION

Recessed lighting is very popular in residential and commercial buildings given its unobtrusive and aesthetically pleasing appearance. Recessed lighting removes from view all electric hardware and wiring, placing everything behind a wall or ceiling. However, it is often desirable to adjust an angle of the light emitted from the light fixture to, for example, create a so-called wall-wash or other directed light beam Accordingly, there is a need in the art for a recessed light fixture that permits the user adjust the position of the lighting element. It is also preferable to provide such adjustments using modular, toollessly mountable components.

The present technology seeks to resolve the needs in the art by providing an adjustable light module for a recessed light fixture that allows adjustment of the direction of the light emitted from the light module through the illumination aperture using module components.

SUMMARY OF THE INVENTION

The light fixture can include a frame adapted to mount the light fixture to a support structure with a room-facing side of the light fixture facing an interior of a room. The frame includes an aperture and a Y axis extending perpendicular to a plane of the aperture. An X axis extends perpendicular to the Y axis, and a Z axis extends perpendicular to the X and Y axis.

The light fixture has a lighting module with a housing and an opening, and the housing is fixedly but removably mounted to the frame within the aperture, from the interior of the room.

A light module body is disposed within the housing and includes lighting elements operable to emit light into the interior of the room.

The light module body is movable relative to the housing into a plurality of positions including a non-tilted position, an intermediate tilted position and a fully-tilted position, and movement of the light module body relative to the housing is limited at the non-tilted limit position and the fully-tilted limit position.

In the non-tilted limit position, an optical axis of the light module body is parallel to the Y axis. In the intermediate tilted position, the optical axis is aligned at a first angle relative to the Y axis, and in the fully-tilted limit position, the optical axis is aligned at a second angle relative to the Y axis greater than the first angle.

The light module body includes an opening through which the light emitted by the lighting elements passes into the interior of the room. The opening of the light module body is defined by a peripheral edge having a first lateral segment extending parallel to the Z axis.

Movement of the light module body relative to the housing between any of the plurality of positions can include rotation about the Z axis and translation parallel to the X and Y axes. During movement of the light module body relative to the housing between and among the non-tilted limit position and the fully-tilted limit position, the first lateral section of the peripheral edge can remain substantially parallel to the Z axis and can maintain a substantially constant vertical position such that it maintains a substantially constant perpendicular distance from the X axis.

Further, during such movement, movement of the first lateral section of the peripheral edge of the light module body can be substantially limited to movement parallel to the X axis.

The frame can include a peripheral flange extending downwardly from the frame on the room-facing side of the light fixture, and the peripheral flange has a free edge. The lighting module can have a trim element connected to the housing with a flange extending laterally outwardly parallel to the X and Z axes beyond the free edge of the peripheral flange of the frame.

The first lateral segment of the peripheral edge of the light module body can remain substantially co-planar with the horizontally outwardly extending flange of the lighting module during movement of the light module body between and among the non-tilted limit position and the fully-tilted limit position.

Further, in the non-tilted limit position, the first lateral section of the peripheral edge of the light module body can be spaced a first distance from an adjacent portion of the flange of the trim element. And, in the fully-tilted limit position, the first lateral section of the peripheral edge of the light module body can be spaced a second distance from the adjacent portion of the flange of the trim element, which second distance is less than the first distance.

The light module body can be coupled to the housing by a four-bar linkage including a first link having a first pivot pivotally coupled to the housing and a second pivot pivotally connected to the light module body, and a second link having a first pivot pivotally coupled to the housing and a second pivot pivotally connected to the light module body.

The second link of the linkage can include a slot having an arcuate shape, wherein the second pivot of the second link is intermediate the slot and the first pivot of the second link. The slot can have first and second ends and a center of curvature located at the first pivot of the second link. A limiter coupled to the housing can be directed through the slot, such that the limiter is fixed relative to the housing and the second link can move relative to the limiter. The slot and limiter cooperate to limit movement of the linkage and light module body. The limiter can contact the first end of the slot when the light module body is in the non-tilted limit position and contacts the second end of the slot in the fully-tilted limit position.

The light module body is operable to be moved by hand between and among the plurality of positions, and the linkage includes means to maintain the light module body in a selected position relative to the housing. The means to maintain the light module body in a selected position includes friction means.

The light module body can include heat sink fins projecting opposite the opening of the light module body which are aligned at an acute angle relative to the optical axis of the light module body. In the non-tilted limit position the heat sink fins can be aligned at the acute angle relative to the Y axis, and in the fully-tilted limit position the heat sink fins can project substantially parallel to the Y axis.

DETAILED DESCRIPTION OF THE INVENTION

Figure 1:
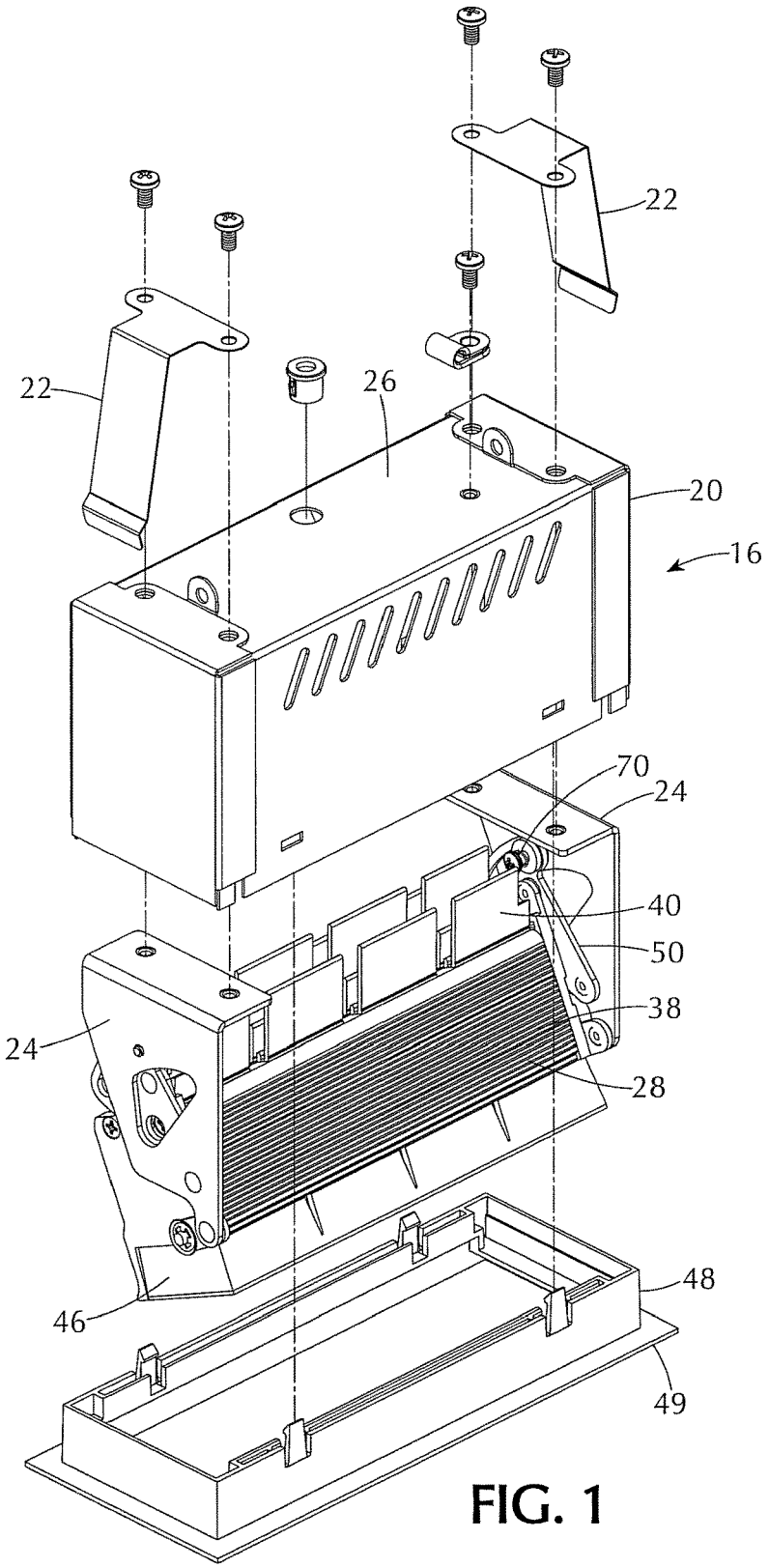
FIG. 1 is an exploded assembly view an adjustable light module in accordance with the present invention.
Figure 2:
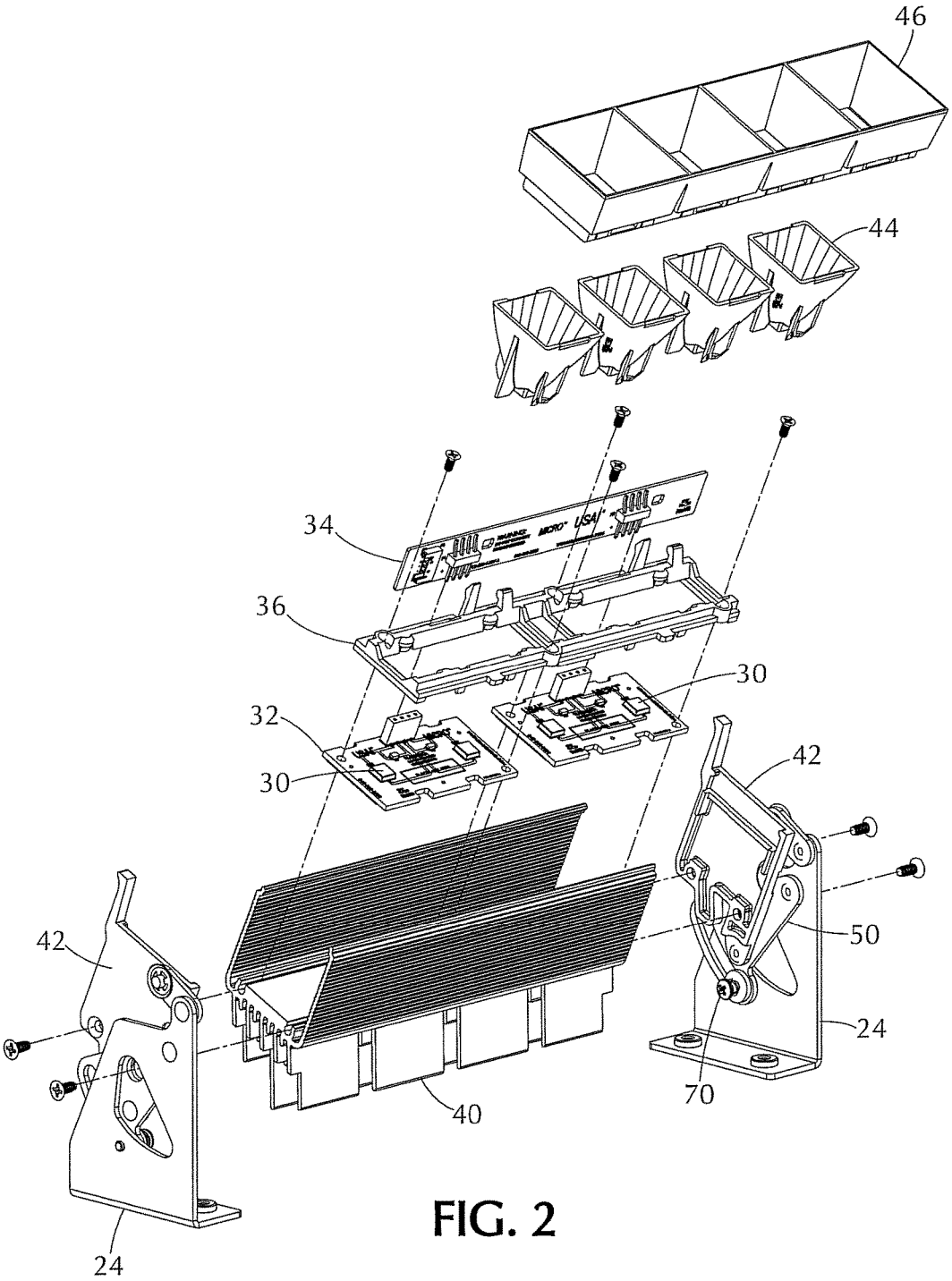
FIG. 2 is an exploded view of the adjustable light module of FIG. 1, showing the components of the tilting light module body.
Figure 3:
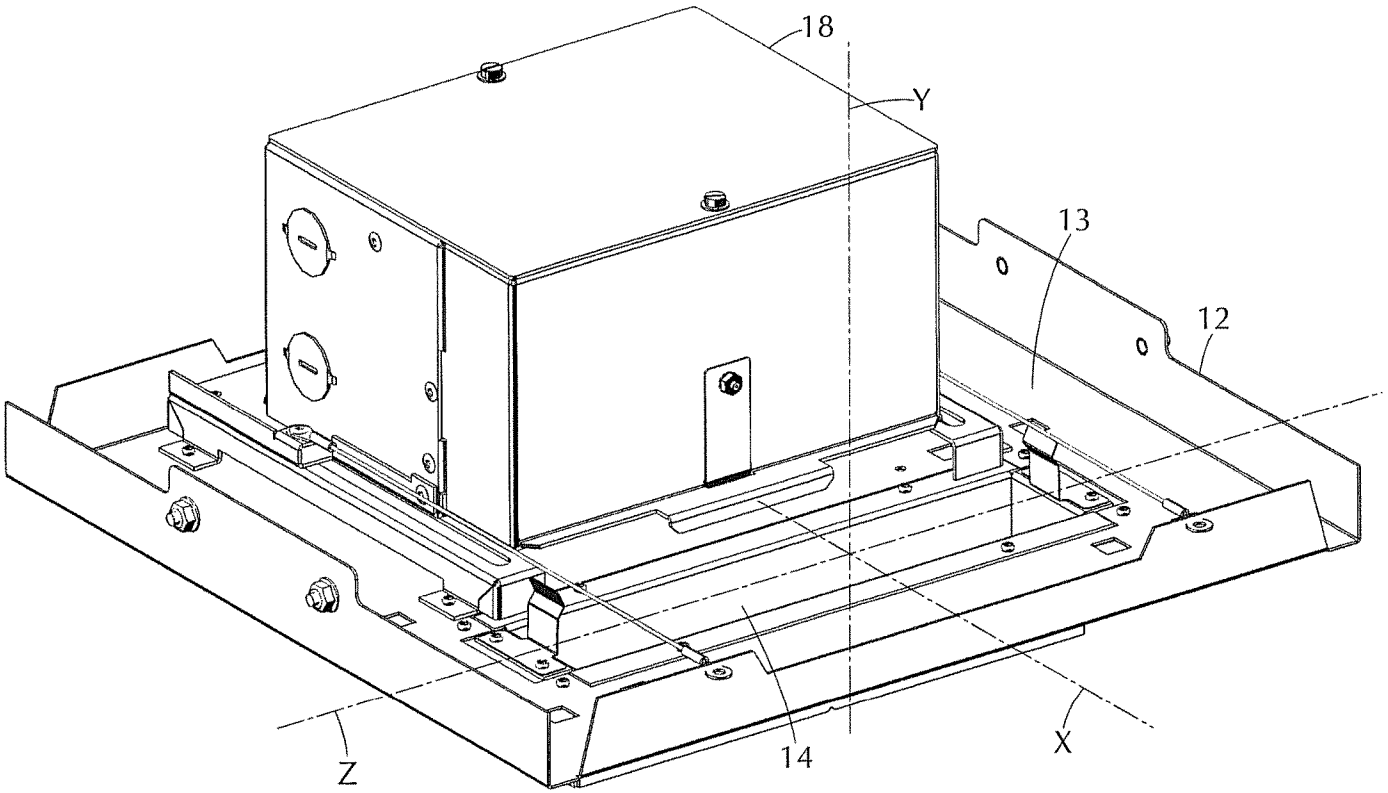
FIG. 3 is a perspective view from the top of a recessed light fixture suitable for the adjustable light module of the present invention.
Figure 4:
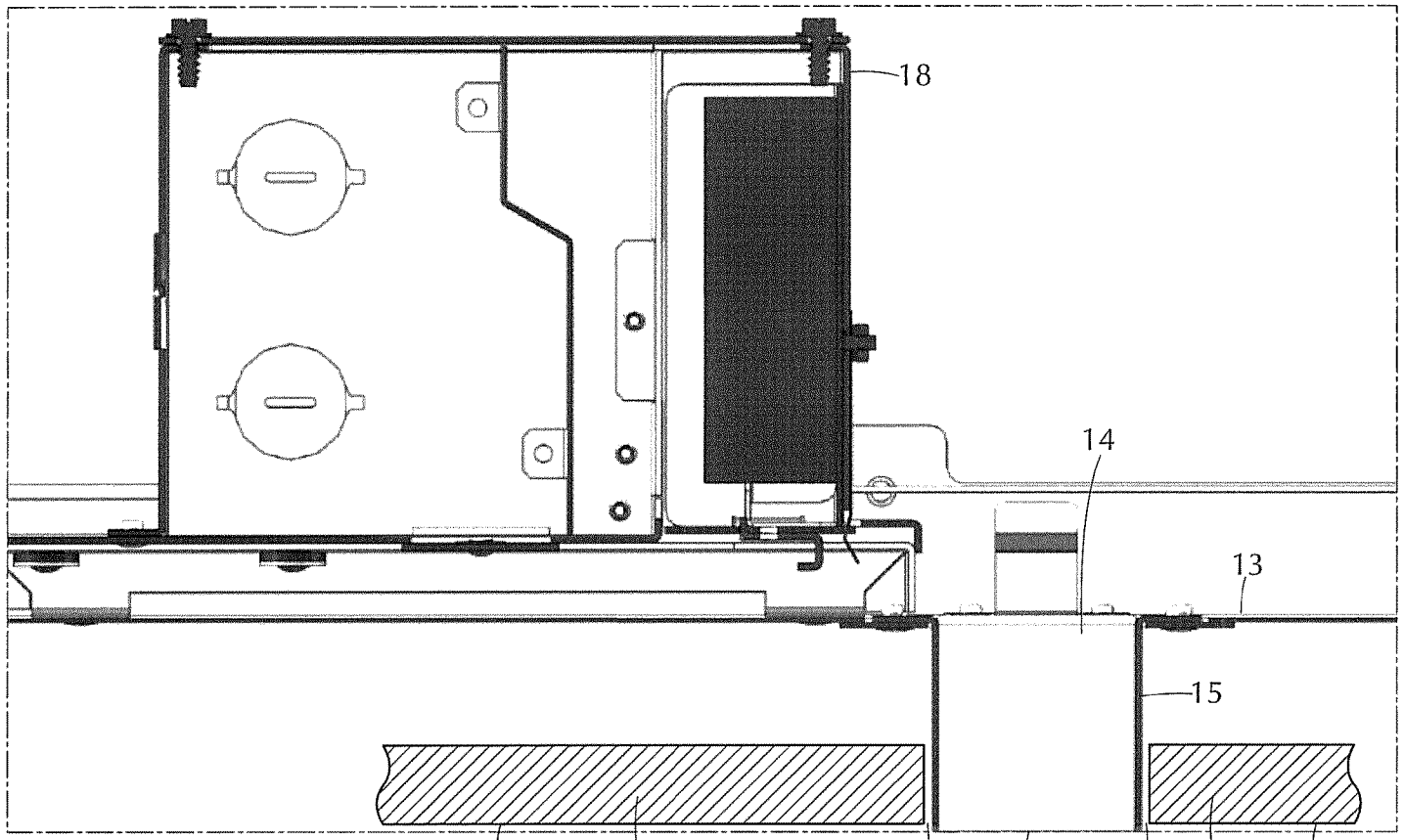
FIG. 4 is a side elevation view of the light fixture of FIG. 3.
Figure 5:
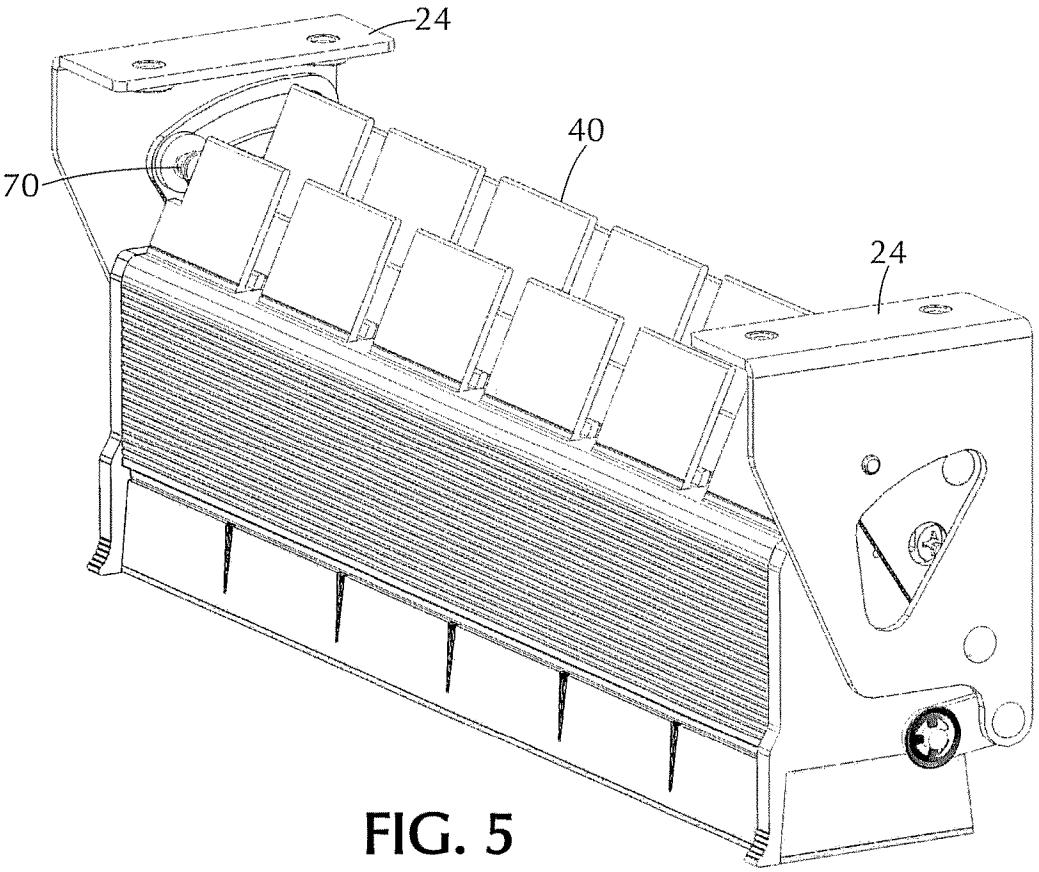
FIG. 5 is a perspective view from the top of the adjustable light module of FIG. 1 showing the light module body in a non-tilted position.
Figure 6:
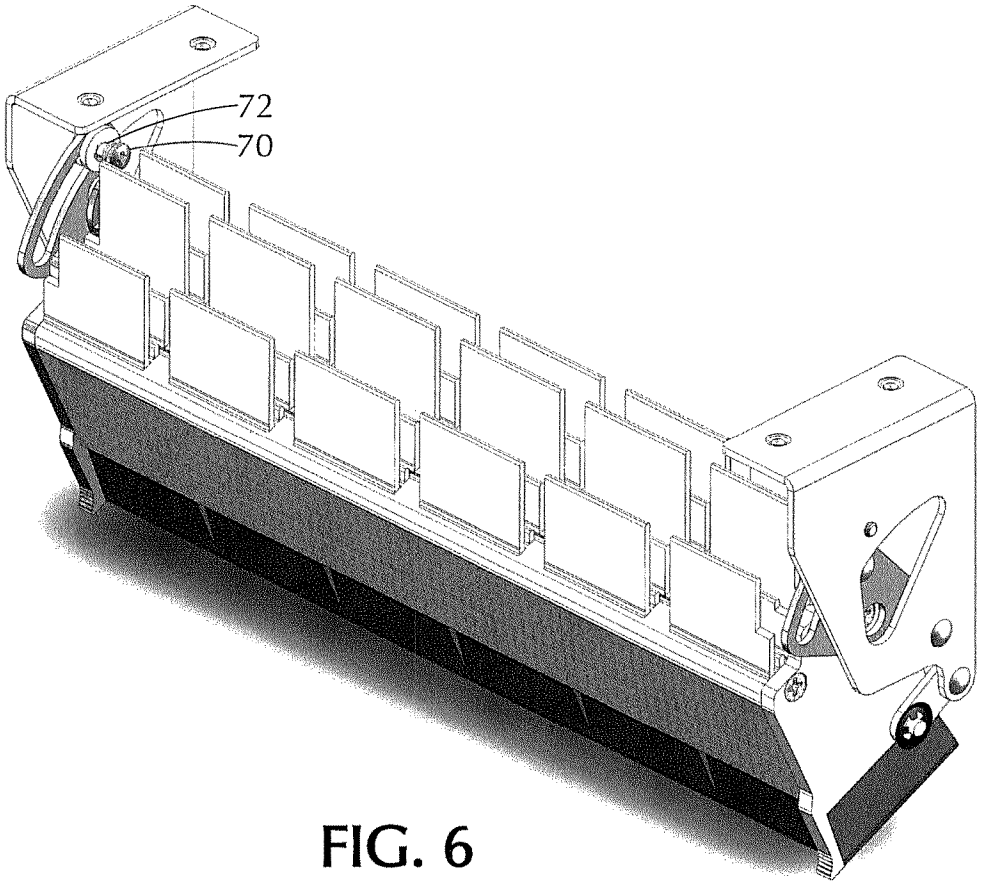
FIG. 6 a perspective view from the top of the light fixture of FIG. 1, showing the light module body in a fully-tilted position.
Figure 7:
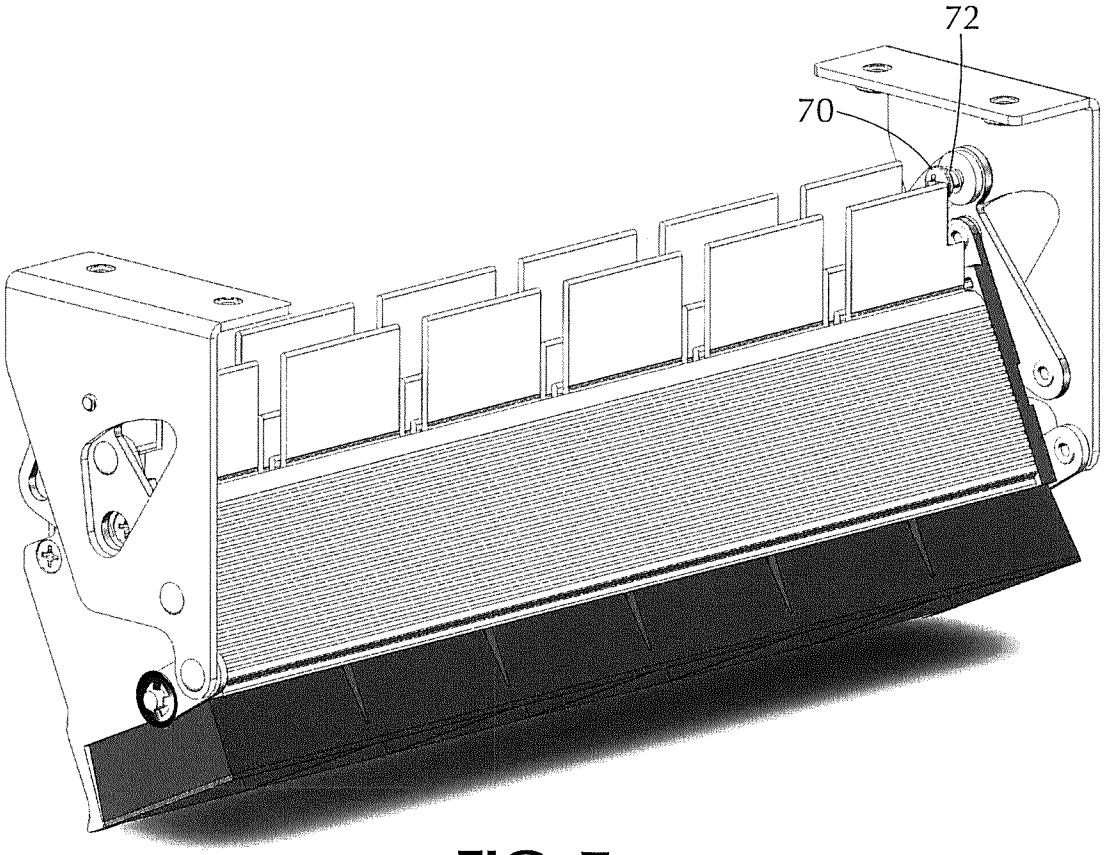
FIG. 7 a perspective view from the back of the light fixture of FIG. 1, showing the light module body in the fully-tilted position.
Figure 8:
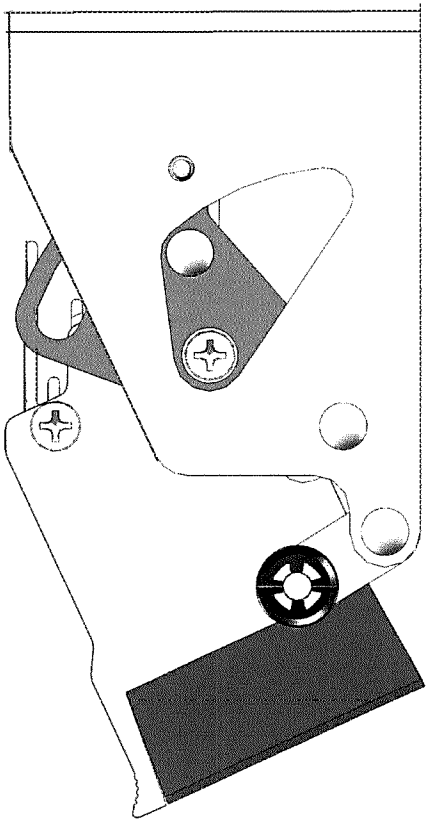
FIG. 8 a side elevation view of the light fixture of FIG. 1, showing the light module body in the fully-tilted position.
Figure 9:
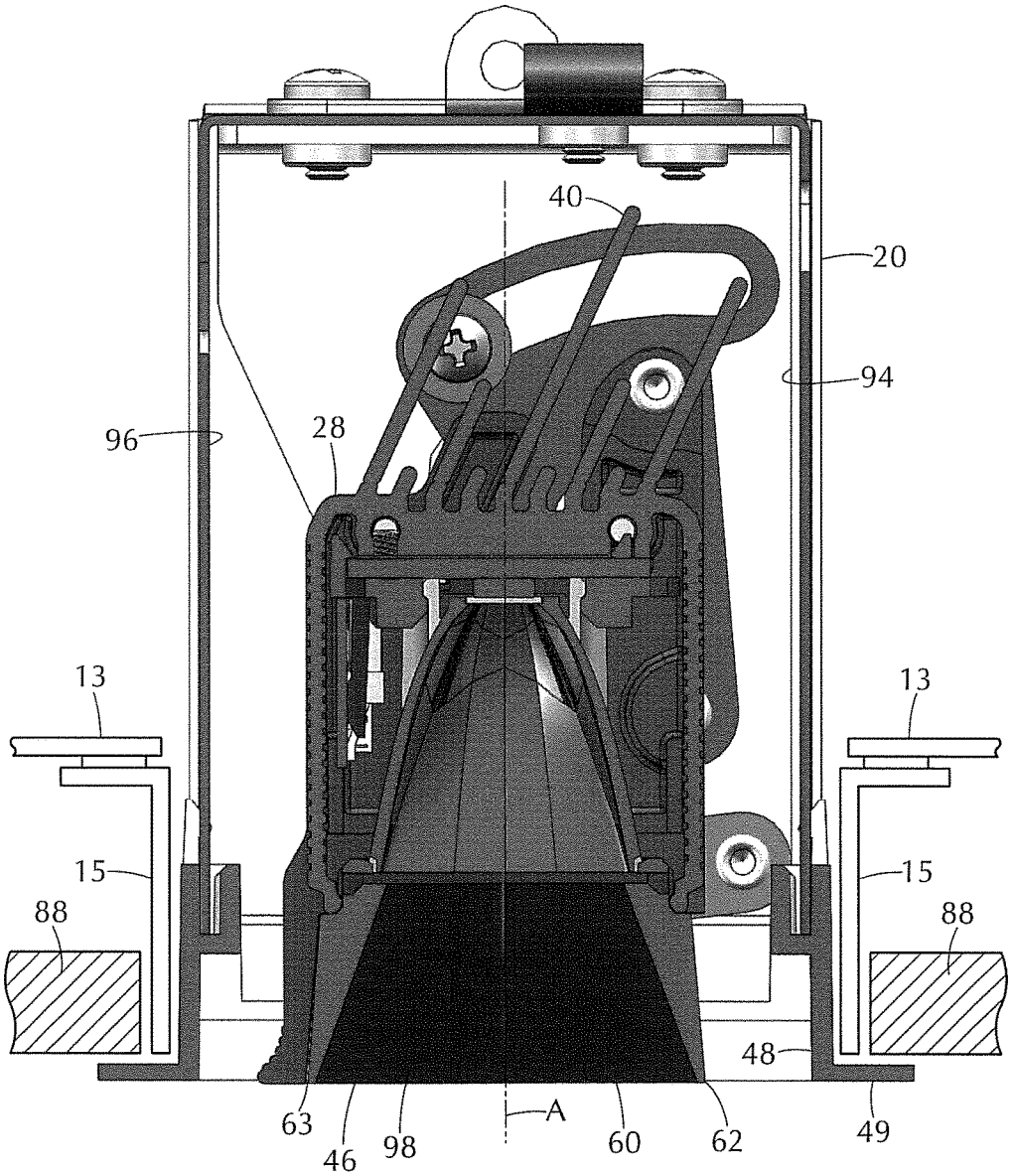
FIG. 9 is side elevation cross section view of the adjustable light module of FIG. 1, showing the light module body in the non-tilted position.
Figure 10:
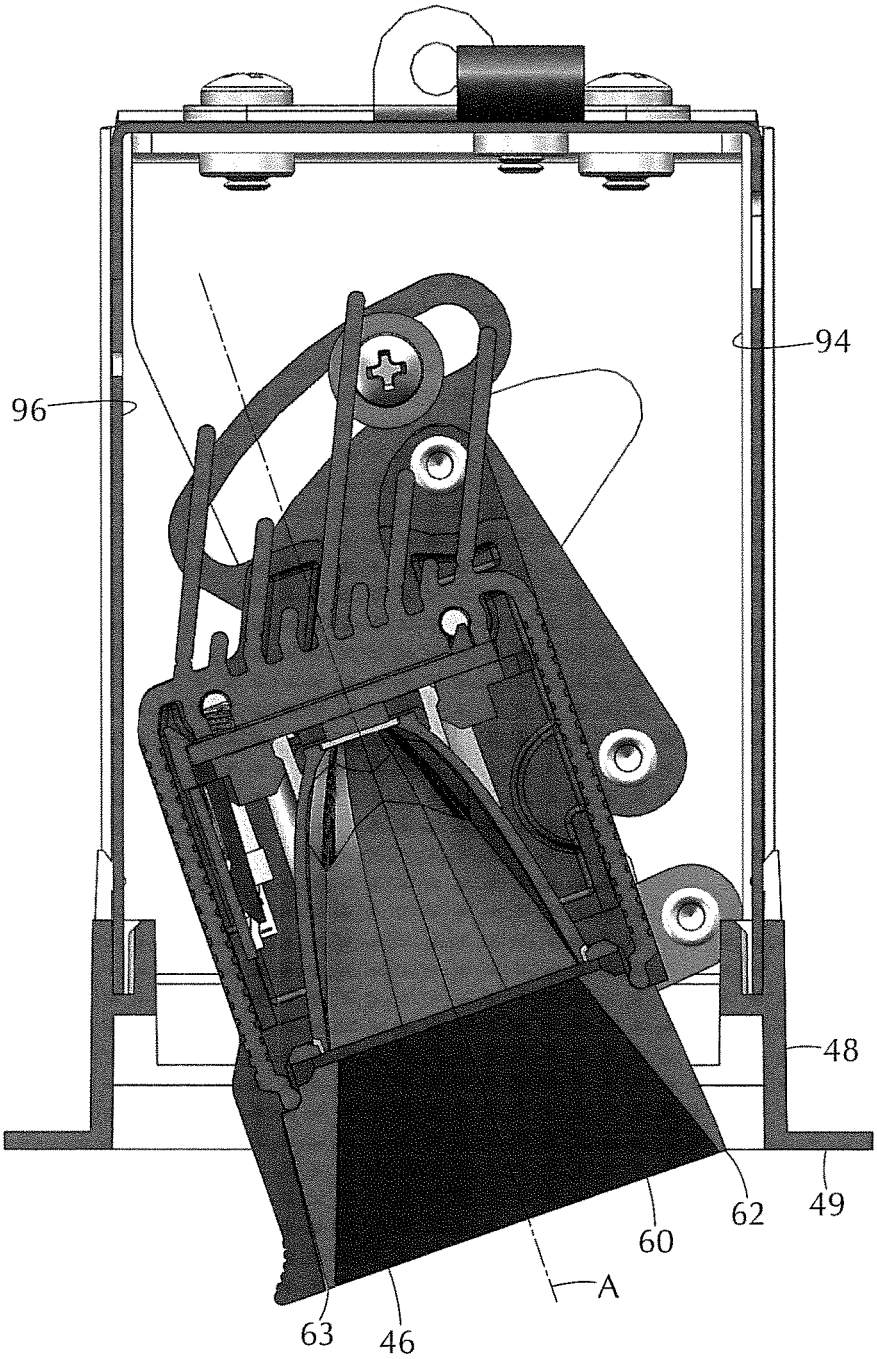
FIG. 10 is side elevation cross section view of the adjustable light module of FIG. 1, showing the light module body in an intermediate tilted position.

The following detailed description illustrates the technology by way of example, not by way of limitation of the principles of the invention. This description will enable one skilled in the art to make and use the technology, and describes several embodiments, adaptations, variations, alternatives, and uses of the invention, including what is presently believed to be the best mode of carrying out the invention. One skilled in the art will recognize alternative variations and arrangements, and the present technology is not limited to those embodiments described hereafter. In some instances, the devices disclosed herein are described as if oriented in a manner to be installed in a horizontal ceiling, using terms such as vertical, horizontal, upper, lower, etc. However, it is to be understood that the devices can be placed and used in other orientations, such as vertical walls or other non-horizontal surfaces and that the orientations and relative positions of the various components of the devices would likewise change.

Referring to FIGS. 1-12, an adjustable light module 16 is especially adapted for installation in a recessed light fixture 10 which can be, for example, mounted in a ceiling or wall location. When installed, the light module 16 is operable to emit light into an interior of the room.

The light fixture 10 typically includes a frame 12 adapted to mount the light fixture to a support structure, such as joists or other structure, with a room-facing side of the light fixture facing the interior of a room. Attachment devices, such as "butterfly" brackets (not shown) or other suitable devices can be connected to the frame 12 to secure the light fixture 10 to such support structure. The frame 12 can have a substantially planar base 13 and up-turned flanges on four sides of the base, extending away from the room-facing side of the light fixture (i.e., away from an interior of the room).

The light fixture 10 can include an enclosure 18 connected to the frame 12 for housing a lighting driver and a junction compartment for housing connections between the lighting driver and a power source (e.g., an A/C power source and a lighting driver operable to receive A/C power and drive LEDs).

The frame 12 of the light fixture 10 includes an aperture 14 in the base 13 which can be elongated and/or rectangular in shape and can be defined at least in part by a peripheral flange 15 surrounding the periphery of the aperture 14 and extending downwardly from the frame 12 on the room-facing side of the light fixture toward the interior of the room. The peripheral flange 15 has a free edge 86. When the room is finished, a finishing panel 88, such as a dry wall panel, can closely surround the peripheral flange 15 and a bottom surface 90 of the finishing panel 88 can be substantially co-planar with the free edge 86. However, a small but visible gap 100 may exist between the finishing panel 88 and the peripheral flange 15. As described below, such gap can be covered by a trim 48 of the lighting module 16.

Preferably, the lighting module 16 (and in particular a housing 20 thereof), the aperture 14, and/or the peripheral flange 15 are sized and shaped such that they have substantially the same (horizontal) cross-section shape and such that the aperture 14 and/or flange 15 closely surround the lighting module 16 when installed. For example, as depicted, both the aperture 14 and the lighting module can have a substantially elongated, rectangular (horizontal) cross section having a horizontal lateral (short) axis (X) and a horizontal longitudinal (long) axis (Z). A vertical axis (Y) passes vertically through the aperture 14 perpendicular to a plane of the aperture, and can be parallel to an optical axis A of the adjustable lighting module 16 when in a non-tilted position. The X, Y, and Z axes are mutually perpendicular.

The light module 16 includes a housing 20 which can be in the form of a five-sided rectangular enclosure with an opening at the bottom. The housing 20 is releasable but fixedly mountable to the frame 12 of the light fixture 10 and is insertable through the aperture 14 of the frame 12 from a room-facing side of the light fixture 10. A pair of resilient retaining clips 22 depend downwardly from opposing ends of the housing 20 and releasably (and toollessly) mount the light module 16 to the frame 12. When the light module 16 is installed, the housing 20 extends upwardly from the base 13 of the frame 12. A trim element 48 is fixedly (but preferably releasably) attached to a bottom edge of the housing 20 and includes a horizontally outwardly extending flange 49 which extends laterally outwardly parallel to the X and Z axes, below and beyond the free edge of the flange 15 of the frame 12, when the light module 16 is installed to cover and conceal the free edge and the gap between the opening in the finishing panel and the flange.

A pair of mounting brackets 24 are disposed within the housing 20 and are fixed to and depend downwardly from an interior surface of a top 26 of the housing 20. The light module 16 has a light module body 28 which is movably mounted to the brackets 24 (or otherwise coupled to the housing 20) for adjusting an angle of the light emitted from the light fixture.

The movable light module body 28 includes a light engine 32 having one or more light emitting elements 30 (such as LEDs), driving electronics 34 operable to drive the lighting elements and a retaining bracket 36. The light module body can include, and the light engine 32 can be affixed to and contained within, a metal, extruded enclosure 38, and specifically to an inside surface of a top wall of the enclosure. The enclosure 28 can be substantially in the form of a channel having heat dissipating fins 40 extending upwardly from a top of the enclosure 38. End cap walls 42 are fixed to opposing ends of the enclosure. The light module body 28 can include a plurality of reflectors 44 disposed around and below the light emitting elements 30 and a segmented trim 46 disposed below the reflectors. As can be appreciated, one or more of the separate components of the light fixture 10, light module 16 and/or light module body 28 thereof can be integrally formed.

Preferably, when the light module 16 is mounted in the light fixture 10, the light module body 28 can be oriented by hand, from the interior of the room, in a number of positions of varying degrees of tilt relative to the housing 20 (and relative to the frame 12 of the light fixture 10) including a non-tilted limit position (See FIG. 9), an intermediate tilted position (FIG. 10), a fully tilted limit position (FIG. 11), and all positions there between.

The light module body has a fixed optical axis. In the non-tilted limit position (FIG. 9), the light module body 28 and the optical axis A thereof are aligned substantially vertically (i.e., zero degrees from vertical), parallel to the Y axis passing perpendicularly through a plane of the aperture 14. In the intermediate tilted position (FIG. 10), the light module body 28 and optical axis A are rotated relative to the Y axis (e.g., 20 degrees from vertical), and in the fully-tilted limit position (FIG. 11), the light module body 28 and optical axis A are further rotated relative to the Y axis (e.g., 30 degrees from vertical or another amount greater amount than the intermediate position). The movement of the light module body 28 from/among the non-tilted position to the fully-tilted position is preferably a combination of rotation about an axis parallel to the Z axis (counterclockwise as viewed in FIGS. 9-11), downward translation parallel to the Y axis and lateral translation parallel to the X axis (to the left in FIGS. 9-11).

The light module body 28 is movably coupled to the housing 20 by a linkage 50, which can include a pair of four-bar linkages, operable to control movement of the light module body 28 relative to the housing 20 (and relative to the light fixture 10). The linkage 50 can comprise, on each end of the light module body 28, a first link 54 having a first pivot 74 pivotally connected to an associated bracket 24 (or housing 20) and a second pivot 76 pivotally connected to the light module body 28, for example to a lower portion of an end cap 42 of the light module body 28. A second link 56 has a first pivot 78 pivotally connected to the associated bracket 24 or housing 20 (at a point above the first link) and a second pivot 80 pivotally connected to the light module body 28, for example to an upper portion of the end cap 42 (at a point above the first link). The light module body 28 (e.g., each end cap 42 thereof) and the housing 20 (e.g., each bracket 24) act as third and fourth links in the four bar-linkage movably supporting the light module body 28 relative to the housing 20.

Figure 11:
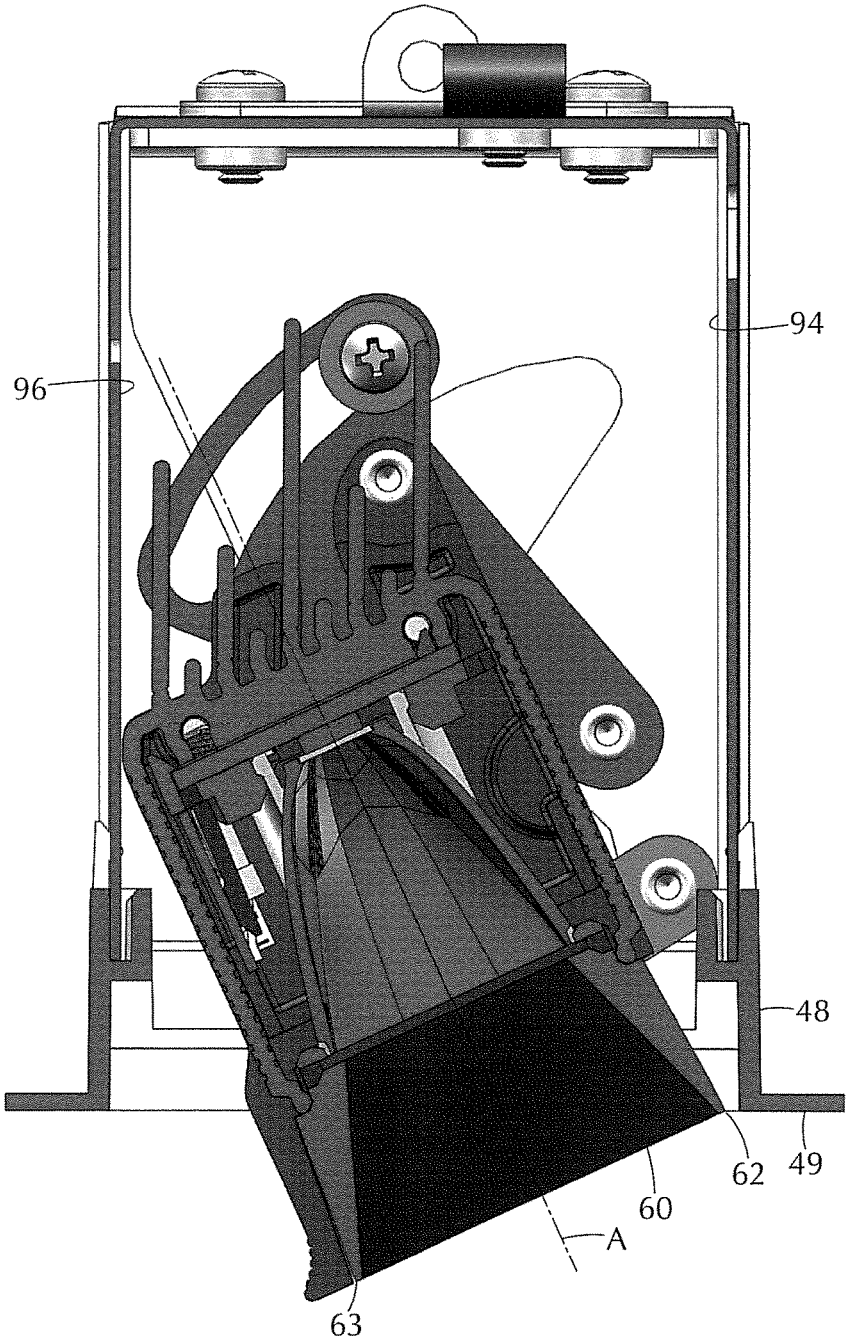
FIG. 11 is side elevation cross section view of the adjustable light module of FIG. 1, showing the light module body in the fully-tilted position.
Figure 12:
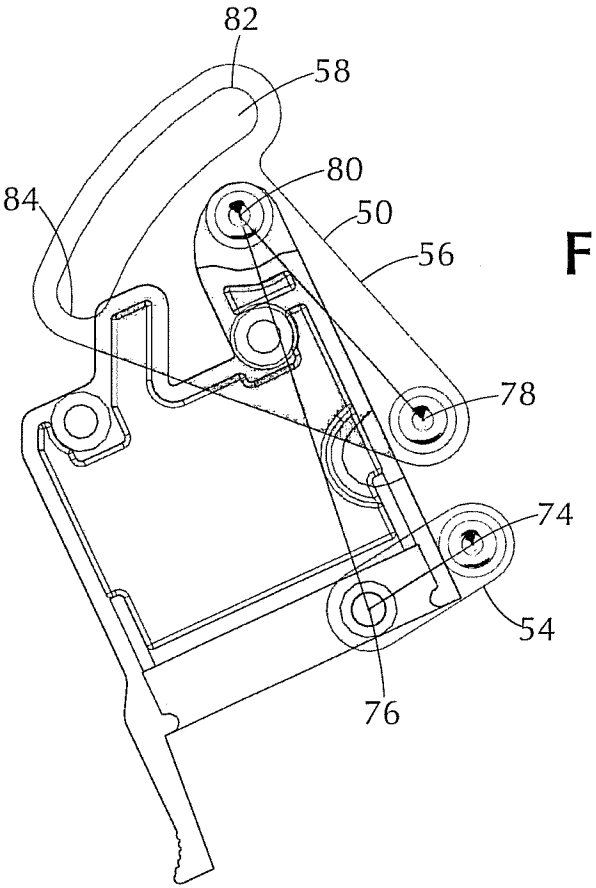
FIG. 12 is a side elevation view of the linkage of the adjustable light module of FIG. 1, in the fully-tilted position.

To limit movement of the light module body 28 relative to the light fixture 10, the second link can include an arcuate slot 58 in a distal end thereof, opposite the first pivot, such that the second pivot is intermediate the slot and the first pivot. The slot has first and second closed ends 82, 84 and has a center of curvature located at the first pivot. A limiter 70, such as a fastener, can be directed through the slot and into the housing 20 or the associated bracket 24 such that the limiter 70 is fixed relative to the housing 20 or bracket 24 and such that the second link 56 can move relative to the limiter 70. The slot 58 and limiter 70 cooperate to limit movement of the linkage 50 and light module body 28 relative to the housing 20. The limiter 70 contacts the first end 82 of the slot 58 when the light module body 28 is in the non-tilted limit position (FIG. 9) and contacts the second end 84 of the slot 58 in the fully-tilted limit position (FIG. 11). The second link 56 and in particular the first and second ends of the slot 58 do not contact or otherwise interfere with opposed lateral side walls 94, 96 of the housing 20 during movement of the light module body 28.

A compressed elastic member 72 (such as a spring) can be disposed around or otherwise attached to the limiter 70, for example between a head of the limiter and the second link 56, such that the elastic member 72 bears directly or indirectly on the second link and causes frictional resistance to movement of the second link relative to the housing 20 sufficient to maintain the light module body 28 in any desired position until manually moved by a user, including the non-tilted, intermediate tilted, and fully-tilted positions, and all positions there between. Other configurations or devices to maintain the light module body 28 in any desired position are also contemplated. For example, the light module 16 or linkage 50 can include other means to generate frictional resistance to relative movement between the light module body 28 and the housing 20, or can include a ratchet mechanism to hold the light module body in any desired position (such as between the limiter and the second link and/or slot thereof), or can include another suitable configuration.

A free, peripheral edge 60 of the light module body 28 (for example a bottom portion of the segmented trim 46) defines an opening 98 at a bottom (i.e., lower-most portion) of the light module body 28 through which light emitted by the lighting elements passes into the room. In the non-tilted limit position, a plane of the opening and the peripheral edge 60 can be substantially parallel to a plane defined by the X and Z axes and can also be substantially coplanar with the flange 49 of the trim 48 connected to the housing 20.

A first lateral section 62 of the peripheral edge 60 is generally parallel to the Z axis. Preferably, during movement of the light module body 28 among the non-tilted and fully-tilted limit positions (and all positions there between), the first lateral section 62 of the peripheral edge 60 remains substantially parallel to the Z axis and maintains a substantially constant vertical position such that it maintains a substantially constant perpendicular distance from the X axis. In addition, the first lateral section 62 can remain substantially coplanar with the flange 49 of the trim 48 connected to the housing 20 during such movement.

As shown, the first section 62 can move horizontally laterally (i.e., parallel to the X axis) toward and away from an adjacent (closest) side of the trim 48 during such movement. In particular, the first lateral section 62 can move closer to the adjacent side of the trim 48 during rotation of the light module body 28 from the non-tilted position to the fully tilted position. More particularly, preferably in the non-tilted limit position, the first lateral section 62 of the peripheral edge 60 of the light module body 28 is spaced a first distance from the adjacent (i.e., closest) portion of the trim element 48, and in the fully-tilted limit position, the first lateral segment 62 of the peripheral edge 60 of the light module body 28 is spaced a second distance from the adjacent portion of the trim element 48, where the second distance is less than the first distance.

A second lateral section 63 of the peripheral edge 60 of the segmented trim 48 (opposite the first lateral section 62 thereof) also is and remains substantially parallel to the Z axis. The second lateral section 63 can be co-planar with the flange 49 of the trim 28 in the non-tilted limit position. However, preferably, the second lateral section 63 drops below the plane of the flange 49 in the tilted positions including the intermediate and fully-tilted positions. Thus, preferably, it does not maintain a constant vertical position or a constant perpendicular distance from the X axis during such movement.

The light module body 28 can include heat sink fins 40 which are preferably arranged in a plurality of parallel rows of fins of varying height which extend parallel to the Z axis and which project upwardly from a top of the light module body 28 in a parallel fashion, at a common angle relative to the optical axis A. The heat sink fins 40 are generally directed in a direction opposite the direction in which the light module body 28 rotates from the non-tilted limit position to the fully-tilted limit position. The heat fins 40 are preferably aligned such that they are substantially vertical (i.e., parallel to the Y axis) when the light module body 28 is in the fully-tilted position (FIG. 11). Thus the heat sink fins 40 are preferably aligned (relative to the optical axis A of the light module body 28) at an angle that is equal to, but in an opposite direction than, an angle between the optical axis A and the Y axis when the light module body 28 is in the fully-tilted position (FIG. 11). For example, if the optical axis is displaced 30 degrees counterclockwise from the Y axis when in the fully-tilted limit position, the heat sink fins 40 can be aligned at an angle of thirty degrees clockwise relative to the optical axis A. With this configuration, the heat sink fins 40 are aligned vertically when the light module body 28 is fully tilted and generally vertically when in the intermediate tilted position, which are the expected common orientations of the tilting light module. Further, the length and positioning of the heat sink fins 40 are arranged such that the heat sink fins 40 do not contact or otherwise interfere with the opposed lateral side walls 94, 96 of the housing 20 when in the limit positions or during movement of the light module body 28 there between.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed:

1. A light fixture, comprising:

a frame adapted to mount the light fixture to a support structure with a room-facing side of the light fixture facing an interior of a room;

the frame including an aperture;

a Y axis extending perpendicular to a plane of the aperture, an X axis extending perpendicular to the Y axis, and a Z axis extending perpendicular to the X and Y axis;

a lighting module having a housing, and the housing being fixedly mounted to the frame within the aperture;

a light module body disposed within the housing and including lighting elements operable to emit light into the interior of the room;

the light module body being movable relative to the housing into a plurality of positions including a non-tilted limit position, an intermediate tilted position and a fully-tilted limit position, and movement of the light module body relative to the housing being limited at the non-tilted limit position and the fully-tilted limit position;

in the non-tilted limit position, an optical axis of the light module body being parallel to the Y axis; in the intermediate tilted position, the optical axis being aligned at a first angle relative to the Y axis; and in the fully-tilted limit position, the optical axis being aligned at a second angle relative to the Y axis greater than the first angle;

the light module body including an opening through which the light emitted by the lighting elements passes into the interior of the room; and the opening of the light module body being defined by a peripheral edge of the light module body, and the peripheral edge has a first lateral segment extending parallel to the Z axis;

movement of the light module body relative to the housing between any of the plurality of positions including rotation about the Z axis and translation parallel to the X and Y axes; and during movement of the light module body relative to the housing between and among the non-tilted limit position and the fully-tilted limit position, the first lateral segment of the peripheral edge remaining substantially parallel to the Z axis and maintaining a substantially constant perpendicular distance from the X axis.

2. The light fixture according to claim 1, wherein during movement of the light module body relative to the housing between and among the non-tilted limit position and the fully-tilted limit position, movement of the first lateral segment of the peripheral edge of the light module body is substantially limited to movement parallel to the X axis.

3. The light fixture according to claim 2, wherein:

the frame includes a peripheral flange extending downwardly from the frame on the room-facing side of the light fixture, and the peripheral flange has a free edge;

the lighting module has a trim element connected to the housing, and the trim element has a flange extending laterally outwardly parallel to the X and Z axes beyond the free edge of the peripheral flange of the frame; and the first lateral segment of the peripheral edge of the light module body remains substantially co-planar with the horizontally outwardly extending flange of the lighting module during movement of the light module body between and among the non-tilted limit position and the fully-tilted limit position.

4. The light fixture according to claim 3, wherein:

in the non-tilted limit position, the first lateral segment of the peripheral edge of the light module body is spaced a first distance from an adjacent portion of the flange of the trim element; and in the fully-tilted limit position, the first lateral segment of the peripheral edge of the light module body is spaced a second distance from the adjacent portion of the flange of the trim element, which second distance is less than the first distance.

5. The light fixture according to claim 1, wherein:

the light module body is coupled to the housing by a linkage;

the linkage comprises a four-bar linkage including a first link having a first pivot pivotally coupled to the housing and a second pivot pivotally connected to the light module body, and a second link having a first pivot pivotally coupled to the housing and a second pivot pivotally connected to the light module body.

6. The light fixture according to claim 5, wherein:

the second link includes a slot having an arcuate shape, wherein the second pivot of the second link is intermediate the slot and the first pivot of the second link;

the slot has first and second ends and has a center of curvature located at the first pivot of the second link;

a limiter coupled to the housing is directed through the slot, such that the limiter is fixed relative to the housing and the second link can move relative to the limiter;

the slot and limiter are operable to limit movement of the linkage and light module body; and the limiter contacts the first end of the slot when the light module body is in the non-tilted limit position and contacts the second end of the slot in the fully-tilted limit position.

7. The light fixture according to claim 6, wherein:

the light module body is operable to be moved by hand between and among the plurality of positions; and the linkage includes means to maintain the light module body in a selected position relative to the housing.

8. The light fixture according to claim 7, wherein:

the means to maintain the light module body in a selected position includes friction means.

9. The light fixture according to claim 1, wherein:

the lighting module is mountable to and removable from the frame from the room-facing side of the light fixture.

10. The light fixture according to claim 1, wherein:

the light module body includes heat sink fins projecting opposite the opening of the light module body;

the heat sink fins are aligned at an acute angle relative to the optical axis of the light module body;

in the non-tilted limit position the heat sink fins are aligned at the acute angle relative to the Y axis; and in the fully-tilted limit position the heat sink fins project substantially parallel to the Y axis.

11. A lighting module for a recessed light fixture, the lighting module comprising:

a housing having an opening;

a Y axis extending perpendicular to a plane of the opening of the housing, an X axis extending perpendicular to the Y axis, and a Z axis extending perpendicular to the X and Y axis;

a light module body disposed within the housing and including lighting elements operable to emit light into an interior of a room;

the light module body being movable relative to the housing into a plurality of positions including a non-tilted limit position, an intermediate tilted position and a fully-tilted limit position, and movement of the light module body relative to the housing being limited at the non-tilted limit position and the fully-tilted limit position;

in the non-tilted limit position, an optical axis of the light module body being parallel to the Y axis; in the intermediate tilted position, the optical axis being aligned at a first angle relative to the Y axis; and in the fully-tilted limit position, the optical axis being aligned at a second angle relative to the Y axis greater than the first angle;

the light module body including an opening through which the light emitted by the lighting elements passes into the interior of the room; and the opening of the light module body being defined by a peripheral edge of the light module body, and the peripheral edge has a first lateral segment extending parallel to the Z axis;

movement of the light module body relative to the housing between any of the plurality of positions including rotation about the Z axis and translation parallel to the X and Y axes; and during movement of the light module body relative to the housing between and among the non-tilted limit position and the fully-tilted limit position, the first lateral segment of the peripheral edge remaining substantially parallel to the Z axis and maintaining a substantially constant perpendicular distance from the X axis.

12. The lighting module according to claim 11, wherein during movement of the light module body relative to the housing between and among the non-tilted limit position and the fully-tilted limit position, movement of the first lateral segment of the peripheral edge of the light module body is substantially limited to movement parallel to the X axis.

13. The lighting module according to claim 12, wherein:

the lighting module has a trim element connected to the housing, and the trim element has a flange extending laterally outwardly parallel to the X and Z axes; and the first lateral segment of the peripheral edge of the light module body remains substantially co-planar with the horizontally outwardly extending flange of the lighting module during movement of the light module body between and among the non-tilted limit position and the fully-tilted limit position.

14. The lighting module according to claim 13, wherein:

in the non-tilted limit position, the first lateral segment of the peripheral edge of the light module body is spaced a first distance from an adjacent portion of the flange of the trim element; and in the fully-tilted limit position, the first lateral segment of the peripheral edge of the light module body is spaced a second distance from the adjacent portion of the flange of the trim element, which second distance is less than the first distance.

15. The lighting module according to claim 11, wherein:

the light module body is coupled to the housing by a linkage;

the linkage comprises a four-bar linkage including a first link having a first pivot pivotally coupled to the housing and a second pivot pivotally connected to the light module body, and a second link having a first pivot pivotally coupled to the housing and a second pivot pivotally connected to the light module body.

16. The lighting module according to claim 15, wherein:

the second link includes a slot having an arcuate shape, wherein the second pivot of the second link is intermediate the slot and the first pivot of the second link;

the slot has first and second ends and has a center of curvature located at the first pivot of the second link;

a limiter coupled to the housing is directed through the slot, such that the limiter is fixed relative to the housing and the second link can move relative to the limiter;

the slot and limiter are operable to limit movement of the linkage and light module body; and the limiter contacts the first end of the slot when the light module body is in the non-tilted limit position and contacts the second end of the slot in the fully-tilted limit position.

17. The lighting module according to claim 16, wherein:

the light module body is operable to be moved by hand between and among the plurality of positions; and the linkage includes means to maintain the light module body in a selected position relative to the housing.

18. The lighting module according to claim 17, wherein:

the means to maintain the light module body in a selected position includes friction means.

19. The lighting module according to claim 11, wherein:

the lighting module is mountable to and removable from a frame from the room-facing side of the light fixture.

* * * * *